US005407076A

United States Patent [19]

Sabet

[11] Patent Number: 5,407,076

[45] Date of Patent: Apr. 18, 1995

[54] COMBINED GREETING CARD AND PRODUCT CONTAINER, AND BLANK THEREFOR

[75] Inventor: Edmond Sabet, Los Angeles, Calif.

[73] Assignee: Milestones Products, Inc., City of Commerce, Calif.

[21] Appl. No.: 255,751

[22] Filed: Jun. 7, 1994

[51] Int. Cl.[6] ..... B65D 85/50

[52] U.S. Cl. ..... 206/581; 206/472; 206/486

[58] Field of Search ..... 206/232, 216, 581, 486, 206/823, 491, 492, 472

[56] References Cited

U.S. PATENT DOCUMENTS 4,433,780 2/1984 Ellis .
4,765,466 8/1988 Ivey .
4,819,864 4/1989 Capuano .
4,840,275 6/1989 Faiola et al. .
4,890,872 1/1990 Passotta et al. ..... 206/581 X
5,038,930 8/1991 Holtkamp, Jr. .
5,096,058 3/1992 Juravin et al. .
5,160,022 11/1992 Mennella ..... 206/232
5,226,532 7/1993 Davidson et al. .
5,232,087 8/1993 Schluger .

*Primary Examiner*—Jacob K. Ackun
*Attorney, Agent, or Firm*—Shlesinger, Arkwright & Garvey

[57] ABSTRACT

A combination greeting card and product-receiving container includes a product-receiving compartment and a flap for covering the same. The flap preferably includes a tab which is received in a corresponding slot when the flap is closed for covering the product-receiving compartment.

20 Claims, 2 Drawing Sheets

COMBINED GREETING CARD AND PRODUCT CONTAINER, AND BLANK THEREFOR

FIELD OF THE INVENTION

This invention relates to a combined greeting card and product container, and blank therefor.

BACKGROUND OF THE INVENTION

Greeting cards are well known, and the marketplace for greeting cards is highly competitive.

Likewise, specialized containers for holding products, such as perfume bottles, are known.

There is a need for a combined greeting card and product container which includes the best of the greeting card and the container worlds.

The following are representative of patented products over which my invention improves.

U.S. Pat. No. 5,096,058 to Juravin et al. discloses a combined greeting card and candy holder which is essentially a box filled with candy having a decorative cover which makes it a greeting card. The Juravin greeting card and candy holder undoubtedly works well, and Juravin et al. even recognized the use of a series of panels for forming the candy container. However, Juravin has drawbacks such as a full-sized elongated reenforcing panel which is offset from the remainder of the Juravin et al. full-sized panels, whereby their blank is somewhat L-shaped in one of their embodiments. Some of the Juravin et al. embodiments eliminated that offset panel and achieved a substantially elongated blank. See for example the Juravin et al. embodiments of FIGS. 6–8 and FIGS. 9–11. The user removes the candy from inside the box through one of the small ends in a traditional fashion.

Another known device is shown in U.S. Pat. No. 5,232,087 to Schluger, which discloses a combination product transmittal package and greeting card. Schluger has a product-receiving compartment which can be accessed from a front panel, unlike Juravin, yet has the drawback of a relatively complicated carton-forming blank.

U.S. Pat. No. 4,840,275 to Faiola et al. discloses a greeting card and package which includes a removable, transparent receptacle for a gift, such as a flower, which receptacle can be removed without damaging the card.

There is still a need for a combined greeting card and product container which overcomes the drawbacks of existing devices.

The use of terms such as "front", "back", "left" and "right", as well as all other relative and descriptive terms are for convenience only, and all equivalent structures and variations are intended to be within the scope of the invention.

OBJECTS AND SUMMARY OF THE INVENTION

It is a first object of the invention to provide a combination greeting card and product container which overcomes the drawbacks of known devices.

Another object of the invention is to provide a combined greeting card and product container which is easy to assemble.

Yet another object of the invention is to provide a combined greeting card and product container which has an integrally formed product-receiving compartment.

Another object of the invention is to provide a combined greeting card and container which is environmentally friendly.

A still further object of the invention is to provide a combined greeting card and container which is readily reusable, and which may be opened and closed repeatedly without significant wear on the components thereof.

A further object of the invention is to provide a combination greeting card and container which is suitable for housing and shipping fragile products.

Yet another object of the invention is to provide a combination greeting card and package which can be readily used by physically challenged persons.

It is yet another object of the invention to provide a combination greeting card and container which is readily assembled.

Yet another object of the invention is to provide a combination greeting card and container forming blank which is easier to manufacture than existing blanks.

A still further object of the invention is to provide a combination greeting card and container blank which is more economical to produce than known blanks.

A yet still further object of the invention is to provide a combination greeting card and container blank having a product-receiving compartment which is an integral part of the blank.

Another object of the invention is to provide a combination greeting card and product container blank having a product-receiving compartment which adds to the structural integrity of the container formed from the blank.

Another object of the invention is to provide a combined greeting card and product-receiving container in which a securing tab for the front cover is directly attached to the front cover.

Another object of the invention is to provide a combined greeting card and container which has a slot formed directly in its corresponding blank, and, hence in the assembled container, which slot receives a tab for securing a cover in place.

A yet further object of the invention is to provide a combination greeting card and container having a double-walled cover which is formed by two folded over panels of the container blank.

Another object of the invention is to provide a combination greeting card and container in which a securing tab is formed from a cover panel.

In summary, therefore, the invention is directed to a combined greeting card and product-receiving container comprising a substantially rectangular container having front, rear, and side panels, a product-receiving compartment disposed in the front panel, a product-covering panel hingedly attached to the left panel, and the product-covering panel being a double-walled panel.

In one preferred embodiment of the invention, the double-walled panel includes a tab extending therefrom and receivable in a slot defined in the container.

In one preferred embodiment of the combined greeting card and product-receiving container blank, the blank includes a plurality of panels each separated from each other by fold lines, a plurality of panels being foldable along the fold lines to form a substantially rectangular container. A product-receiving compartment cut-out is formed in the first one of the plurality of panels, and a slot-defining cut-out is formed substantially adjacent one of the fold lines disposed adjacent the first one of the first plurality of panels. The slot-defining cut-out is configured for forming a slot when the blank is erected, and a tab-defining cut-out formed substantially within one of a plurality of panels is configured for forming a tab insertable into the slot when the blank is erected.

The invention will be further described with reference to the following drawings.

DETAILED DESCRIPTION OF THE INVENTION

Figure 1:
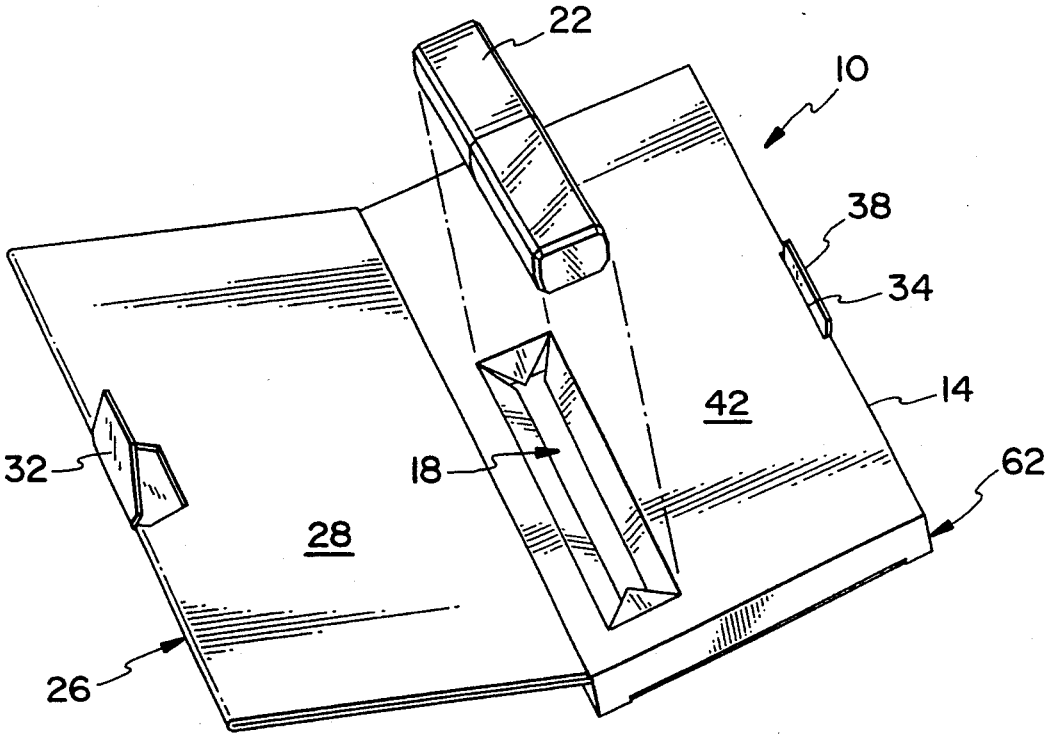
FIG. 1 is a perspective view of a combination greeting card and container according to the invention.
Figure 2:
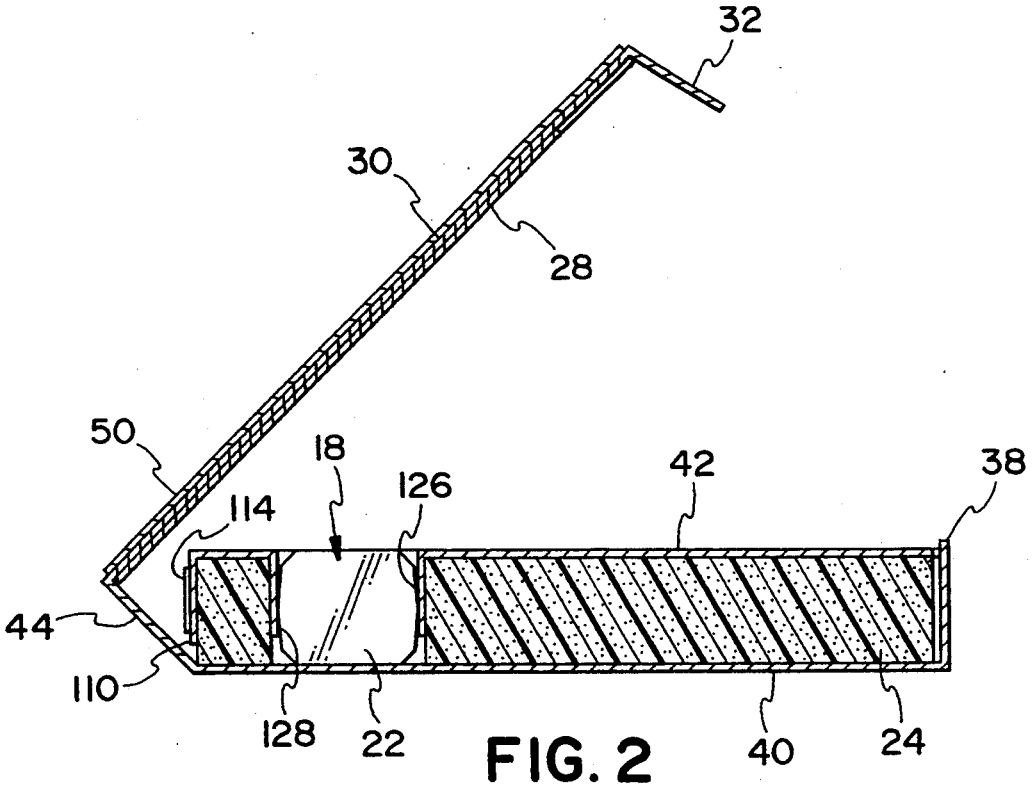
FIG. 2 is a cross-sectional view of the combination greeting card and container according to the invention during assembly thereof.
Figure 3:
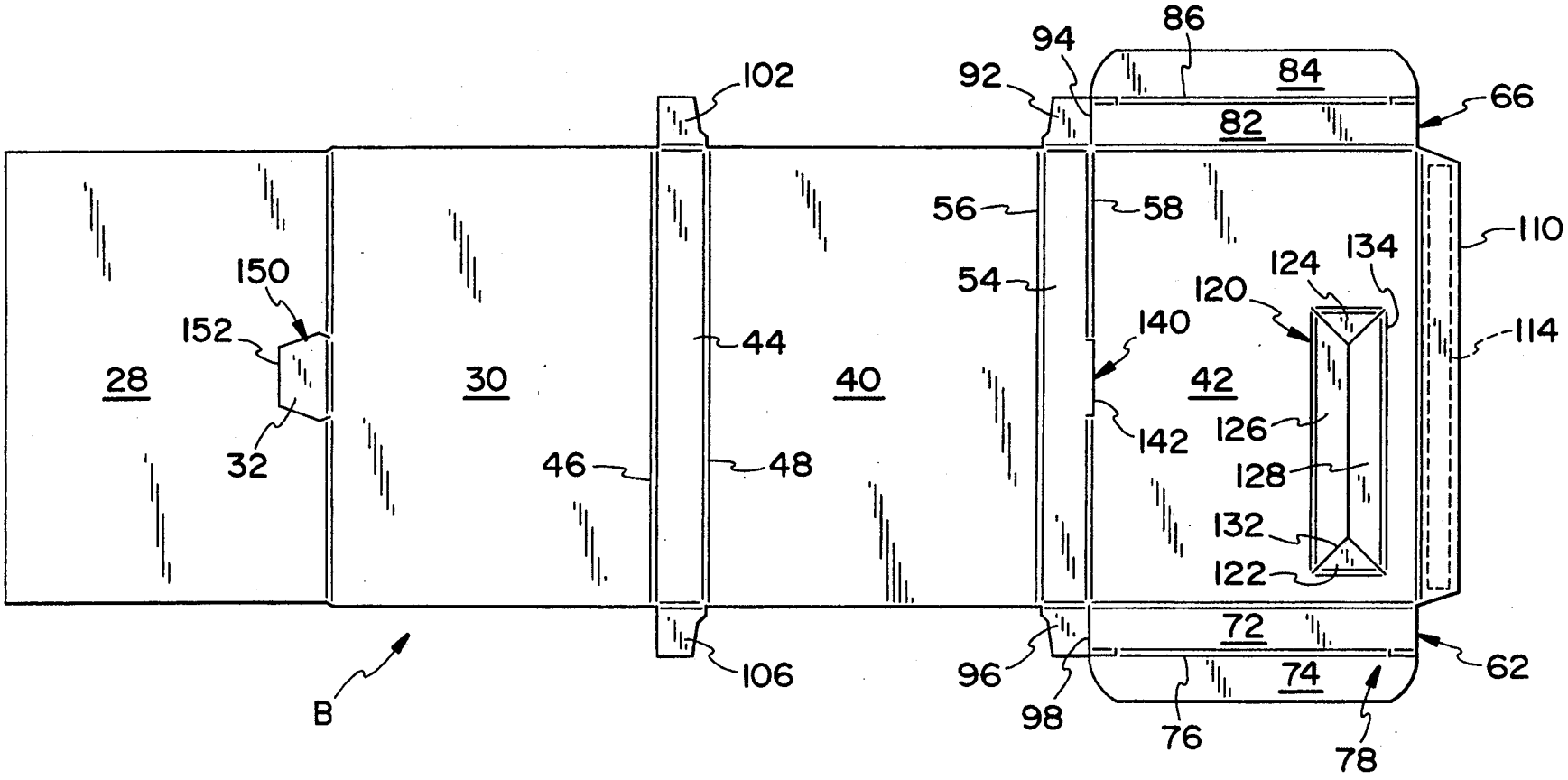
FIG. 3 is a top plan view of the interior of the carton blank for forming the embodiment of FIG. 1.

FIGS. 1–3 illustrate an embodiment of a combination greeting card and product container 10, and a blank therefor, according to my invention.

Combination greeting card and product holder 10 may be made from a standard carton board as desired by the trade and/or the marketplace and the blank for forming combination greeting card container 10 will be described in greater detail below with regard to FIG. 3.

Turning to FIGS. 1 and 2, the combined greeting card/product holder 10 includes a container 14 having a receptacle 18 or compartment defined therein. Receptacle 18 is configured for receiving and securing a product 22, such as the illustrated perfume bottle. Product 22 is shown spaced above receptacle 18.

A lid or flap 26 may be provided for covering receptacle 18 and hence product 22, and may be used to assist in securing product 22 in place, as desired. Flap 26 may include an interior display panel 28 as well as an exterior display panel 30, as best appreciated from FIG. 2.

A tab 32, which may be configured for interlocking with an associated slot 34, is provided for securing flap 26 in place when in its closed position. An upwardly directed extension 38 may be provided adjacent slot 34.

A rear display panel 40 is provided spaced apart from a front display panel 42 which at least partially surrounds receptacle 18.

An optional separate display panel 50, such as a piece of printed matter, may be disposed on top of exterior display panel 30.

Turning to FIG. 3, a blank B from which the combined greeting card and product-receiving container 10 may be formed is illustrated. The blank B is illustrated in a top plan view showing the surfaces which will become interior surfaces when the blank is folded up and formed into the combination greeting card and product holder 10 of FIGS. 1 and 2. Relative terms such as inner, left, and right, are used for convenience, as it will be readily appreciated that the blank of FIG. 3 could be folded so that the depicted surfaces become outer surfaces, and that the relative positions of the panels, cut-outs, and hinge lines, for example, could be shifted in accordance with my invention.

Blank B is provided with an intermediate panel 44 disposed between exterior display panel 30 and rear display panel 40, and joined thereto by respective hinge lines 46 and 48. The term hinge line refers generally to single hinge lines, the illustrated double hinge lines, partially scored fold lines, and, depending on the end use of the product or the method by which the product is assembled, no hinge lines at all, as will be readily appreciated.

A further intermediate panel 54 is disposed between rear display panel 40 and front display panel 42. A hinge line 56 may separate intermediate panel 54 from rear display panel 40, and a hinge line 58 may separate further intermediate panel 54 from front display panel 42.

It is contemplated that a pair of closing end flaps 62, 66 will be provided at opposite ends of front display panel 42. Closing end flap 62 may include an end panel 72 hingedly attached to front display panel 42. An end tab 74 is likewise hingedly attached along hinge lines 76, which hinge lines 76 may be partially scored or completely cut through, such as in the vicinity of portion 78.

Closing end flap 66 includes an end panel 82, and an end tab 84 attached thereto along hinge lines 86, and is similar to closing end flap 62.

A further tab 92 can be provided at an outer end of intermediate panel 54 and adjacent to closing end flap 66. Typically, a cut-through 94 will separate tab 92 from closing end flap 66. A second further tab 96 can be provided at an opposite end of intermediate panel 54 from tab 92. Tab 96 is separated from closing end flap 62 by a cut-through 98.

It is also contemplated that a pair of end flaps 102 and 106 will be provided on opposite ends of intermediate panel 44.

A sealing flap 110 is provided along an outer portion of front display panel 42. It is expected that a gluing region 114 will be provided on an exterior face of sealing flap 110.

A product-receiving cut-out 120 may include a bottom sidewall-defining cut-out 122, a top sidewall-defining cut-out 124, and left and right sidewall-defining cut-outs 126, 128. A plurality of cut lines 132 separate respective portions of product-receiving cut-out 120 and each of the sidewalls 122, 124, 126, and 128 may be provided with respective hinge lines, such as at 134.

Good results have been achieved when an extension-defining cut-out 140 is provided in front display panel 42. A free edge 142 of extension-defining cut-out 140 preferably extends inwardly into front display panel 42 further than the rightmost one of hinge lines 58. Good results have been achieved when extension 38 is formed as a direct, substantially rigid extension of intermediate panel 54; i.e., when there are no hinge lines 58 in the region of extension-defining cut-out 140.

Good results have also been achieved when a tab-defining cut-out 150 has been formed substantially within interior display panel 28 for defining tab 32 when blank B is assembled into combination greeting card and product container 10.

OPERATION

The basic operation of combination greeting card and product holder 10 as operated by the ultimate end user will be readily appreciated from FIGS. 1 and 2. To access product 22 the user rotates flap 26 upwardly (i.e., counterclockwise as viewed in FIG. 2) away from front display panel 42. Tab 32 will consequently have been freed from slot 34. The user will look at any designs or printed sentiments, for example, displayed on interior display panel 28 and front display panel 42. In order to use product 22, such as the depicted perfume, the user removes product 22 from receptacle 18. After using product 22, the user replaces it in receptacle 18, and pushes flap 26 downwardly while guiding tab 32 into slot 34. Upwardly extending extension 38 assists in guiding tab 32 into slot 34 by making it easier for the user to align slot 34 and tab 32.

Referring now to FIGS. 2 and 3, the assembly of blank B into the erected state of combination greeting card and product holder 10 will amplify the use of the invention. Blank B will be cut and formed from typical box-forming materials, such as heavy paper or cardboard.

The starting material is cut and formed to make the blank B shown in FIG. 3. For purposes of description, the illustrated blank will be considered as displaying the panels which will end up in the interior of the erected container 14.

All through cuts, such as cut-throughs 94 and 98, and cut lines 132 and 152, are executed in a conventional manner. Hinge lines/fold lines 56 and 58, for example, are likewise concurrently formed.

Conventional box-forming machinery will erect carton B as follows.

Front display panel 42 is folded along hinge line 58, and rear display panel 40 is folded along hinge line 56 until front display panel 42 is substantially parallel to rear display panel 40, as seen in FIG. 2. Intermediate panel 44 and sealing flap 110 are folded about their respective hinge lines and the inner surface of intermediate panel 44 is attached to the outer surface of sealing flap 110 by means of gluing region 114. The partially assembled state of combination greeting card and product holder 10 just prior to the gluing of gluing region 114 to intermediate panel 44 is shown in FIG. 2.

Flap 26 is formed by the folding of interior display panel 28 about the hinge lines separating it from exterior display panel 30 and sealingly joining the two together. Cut lines 152 ensure that tab-defining cut-out 150 is separated from interior display panel 28 when panel 28 is folded so that tab 32 is provided.

Conventional adhesives can be used to fix interior display panel 28 in position abutting exterior display panel 30, whereby a double-walled cover 26 is formed.

Additional exterior decoration can be provided by attaching separate display panel 50 to the exterior surface of exterior display panel 30, as best seen in FIG. 2. It will be appreciated that additional, separate decorative pieces may be adhered to other surfaces.

Support 34, which preferably is a piece of expanded polystyrene (e.g, STYROFOAM TM), cardboard, or the like, is located between rear display panel 40 and front display panel 42 typically after sealing flap 110 has been adhered to intermediate flap 44. Thus, typically, the basic erected, tubular form defined by rear display panel 40, intermediate panel 54, front display panel 42, and intermediate panel 44 and sealing flap 110 adjoining each other, has been erected.

The erection of the basic form prior to the insertion of support 24 yields the advantageous feature that support 24 need not be glued in place. No affixing of support 24 in place is required, because after support 24 is inserted into position between front display panel 42 and rear display panel 40, each one of the top, bottom, left, and right cut-outs 122, 124, 126, and 128 is folded inwardly downwardly toward rear display panel 40 away from their respective initial positions substantially in a plane defined by front display panel 42. The sidewalls of receptacle 18 thus defined by cut-outs 122–128 maintain support 24 in place. In addition, closing end flaps 62 and 66 likewise maintain support 24 in place.

As will be readily appreciated, after support 24 is positioned in place, and before or after receptacle 18 has been given its final form, tabs 92 and 96, as well as end flaps 102 and 106 are folded along respective fold lines to extend substantially perpendicular to respective intermediate panels 44 and 54 and in abutment with support 24.

Finally, closing end flaps 62 and 66 are placed in their closed positions. Closing end flap 62 is positioned by folding end tab 74 about hinge lines 76, and then folding end panel 72 about its fold line until it abuts and extends parallel to tab 96 (i.e., substantially perpendicular to the face of front display panel 42), which abutment will occur substantially simultaneously with the insertion of end tab 74 into a space defined between support 24 and rear display panel 40. Closing end flap 66 will be erected in a similar fashion. Thus, a parallelepiped or "rectangular" container with a product-receiving compartment and covering flap is formed.

It can be appreciated that the use of double-walled flap 26 has the advantages that all graphics can be printed on one side of blank B, and the end product can have graphics on all visible faces, as desired.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

I claim:

1. A combined greeting card and product-receiving container comprising:

a) a substantially rectangular container;

b) said substantially rectangular container having a front panel defining a front face, a rear panel defining a rear face, and a top, bottom, left, and right panel each disposed between and connecting said front panel and said rear panel;

c) a product-receiving compartment disposed in said front panel;

d) a product-covering panel hingedly attached to said left panel;

e) a tab attached to said left panel distant from said front panel; and f) a tab-receiving slot disposed adjacent said right panel and distant from said product-covering panel.

2. A combined greeting card and product-receiving container as defined in claim 1, wherein:

a) an extension is disposed adjacent to said tab-receiving slot, and said extension is configured for guiding said tab into said slot when said tab is inserted therein.

3. A combined greeting card and product-receiving container as defined in claim 1, wherein:

a) said tab is integrally attached to said left panel.

4. A combined greeting card and product-receiving container as defined in claim 3, wherein:

a) a tab cut-out is defined in said left panel, and said tab cut-out corresponds to said tab.

5. A combined greeting card and product-receiving container made from a blank having a plurality of panels, comprising:

a) said plurality of panels being defined by and separated by a plurality of fold lines, said plurality of panels being folded along respective ones of said fold lines into a parallelepiped;

b) a product-receiving compartment defined in a front panel of said parallelepiped;

c) a cover panel hingedly attached to a left edge of said front panel;

d) a tab hingedly attached to said cover panel at a distance from said front panel;

e) said tab being defined by a cut-out portion of one of said inner and outer cover panels;

f) a slot disposed in an edge of said front panel and distant from said cover panel; and g) said slot being configured for receiving said tab when said cover panel is folded down adjacent to said front panel for covering said product-receiving compartment.

6. A combined greeting card and product-receiving container made from a blank having a plurality of panels as defined in claim 5, wherein:

a) an extension is disposed adjacent said slot, and said extension is configured for guiding said tab into said slot.

7. A combined greeting card and product-receiving container made from a blank having a plurality of panels as defined in claim 5, wherein:

a) a support is disposed between said front panel and a rear panel of said parallelepiped.

8. A combined greeting card and product-receiving container blank, comprising:

a) a plurality of panels, each of said plurality of panels being separated by a fold line;

b) said plurality of panels being foldable along said fold lines to form a substantially rectangular container;

c) a product-receiving compartment cut-out formed in a first one of said plurality of panels;

d) said product-receiving compartment cut-out being configured for forming a product-receiving compartment when said blank is erected;

e) a slot-defining cut-out formed substantially adjacent one of said fold lines which is disposed adjacent said first one of said plurality of panels;

f) said slot-defining cut-out being configured for forming a slot when said blank is erected;

g) a tab-defining cut-out formed substantially adjacent one of said fold lines disposed adjacent a second one of said plurality of panels; and h) said tab-defining cut-out being configured for forming a tab alignable with and insertable into said slot when said blank is erected.

9. A combined greeting card and product-receiving blank as defined in claim 8, wherein:

a) a third one of said plurality of panels is disposed between said first panel and said second panel.

10. A combined greeting card and product-receiving blank as defined in claim 9, wherein:

a) a fourth one of said plurality of panels is disposed adjacent to said second panel and spaced apart from said third panel.

11. A combined greeting card and product-receiving blank as defined in claim 10, wherein:

a) said tab-defining cut-out is formed substantially within said fourth panel.

12. A combined greeting card and product-receiving blank as defined in claim 8, wherein:

a) one of said plurality of panels is a product-covering panel;

b) said tab-defining cut-out is formed substantially within said product-covering panel; and c) said product-covering panel is configured for covering said product-receiving cut-out when said blank is erected.

13. A combined greeting card and product-receiving blank as defined in claim 8, wherein:

a) an intermediate panel is disposed between said first and second ones of said plurality of panels.

14. A combined greeting card and product-receiving blank as defined in claim 13, wherein:

a) a tab is provided at an outer end of said intermediate panel.

15. A combined greeting card and product-receiving blank as defined in claim 9, wherein:

a) an intermediate panel is disposed between said third and second ones of said plurality of panels.

16. A combined greeting card and product-receiving blank as defined in claim 15, wherein:

a) a tab is provided at an outer end of said intermediate panel.

17. A combined greeting card and product-receiving container blank having a plurality of panels, comprising:

a) said plurality of panels being defined by and separated by a plurality of fold lines, said plurality of panels being foldable along respective ones of said fold lines into a parallelepiped;

b) a product-receiving compartment cut-out defined in a front panel of said plurality of panels;

c) a cover panel hingedly attached to a left edge of said front panel;

d) a tab hingedly attached to said cover panel at a distance from said front panel;

e) said tab being defined by a cut-out portion of one of said inner and outer cover panels;

f) a slot cut-out disposed in an edge of said front panel and distant from said cover panel; and g) said slot cut-out being configured for forming a slot receiving said tab when said blank is erected into a combined greeting card and product-receiving container.

18. A combined greeting card and product-receiving container blank having a plurality of panels as defined in claim 17, wherein:

a) an extension defining cut-out is disposed adjacent said slot cut-out, and said extension-defining cut-out is configured for forming an extension configured for guiding said tab into said slot when said blank is erected into a combined greeting card and product-receiving container.

19. A combined greeting card and product-receiving container as defined in claim 1, wherein:

a) said product-covering panel is a double-walled panel including an inner wall and an outer wall.

20. A combined greeting card and product-receiving container made from a blank having a plurality of panels as defined in claim 5, wherein:

a) said cover panel includes a pair of substantially adjacent panels configured for defining an inner wall and an outer wall when said blank is erected into a combined greeting card and product-receiving container.

* * * * *